US009502784B2

(12) United States Patent
Ohnuma

(10) Patent No.: US 9,502,784 B2
(45) Date of Patent: Nov. 22, 2016

(54) TERMINAL ATTACHED ALUMINUM ELECTRIC WIRE

(71) Applicant: Yazaki Corporation, Minato-ku, Tokyo (JP)

(72) Inventor: Kentaro Ohnuma, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/418,755

(22) PCT Filed: Jul. 29, 2013

(86) PCT No.: PCT/JP2013/070510

§ 371 (c)(1),
(2) Date: Jan. 30, 2015

(87) PCT Pub. No.: WO2014/021275

PCT Pub. Date: Feb. 6, 2014

(65) Prior Publication Data

US 2015/0180138 A1 Jun. 25, 2015

(30) Foreign Application Priority Data

Jul. 30, 2012 (JP) ..... 2012-168155

(51) Int. Cl.
*H01R 4/18* (2006.01)
*H01R 4/62* (2006.01)
*H01R 43/28* (2006.01)

(52) U.S. Cl.
CPC ..... *H01R 4/18* (2013.01); *H01R 4/185* (2013.01); *H01R 4/62* (2013.01); *H01R 43/28* (2013.01)

(58) Field of Classification Search
CPC ..... H01R 4/18
USPC ..... 174/84 C
See application file for complete search history.

(56) References Cited

U.S. PATENT DOCUMENTS 7,931,510 B2 4/2011 Fukase
8,221,171 B2 7/2012 Ono et al.

(Continued)

FOREIGN PATENT DOCUMENTS

CN 101842939 A 9/2010
JP 2009-117039 A 5/2009

(Continued)

OTHER PUBLICATIONS

Feb. 3, 2015—(WO) International Perliminary Report on Patentability & Written Opinion of the ISA—App PCT/JP2013/070510, Eng Tran.

(Continued)

*Primary Examiner* — Hoa C Nguyen
*Assistant Examiner* — Stanley Tso
(74) *Attorney, Agent, or Firm* — Banner & Witcoff, Ltd.

(57) ABSTRACT

A conductor of an aluminum electric wire having a solder coating film thereon is placed on a conductor crimping part. The conductor crimping part includes a strongly crimped part where solder coating film of the conductor part is crimped with a strength to allow a break to occur due to application of a crimping force, and a weakly crimped part where solder coating film of the conductor part is crimped with a strength to prevent a break from occurring due to application of the crimping force. The conductor part and the conductor crimping part are electrically connected.

4 Claims, 8 Drawing Sheets

(56) References Cited

U.S. PATENT DOCUMENTS

| | | | | |
|---|---|---|---|---|
| 8,622,775 | B2 | 1/2014 | Takashima et al. | |
| 8,802,987 | B2 | 8/2014 | Morikawa et al. | |
| 9,209,615 | B2 | 12/2015 | Ono et al. | |
| 2010/0230160 | A1 | 9/2010 | Ono et al. | |
| 2010/0248559 | A1 | 9/2010 | Fukase | |
| 2010/0261391 | A1 | 10/2010 | Ono et al. | |
| 2013/0008714 | A1* | 1/2013 | Morikawa | H01R 4/20 174/74 R |
| 2013/0040511 | A1 | 2/2013 | Takashima et al. | |
| 2013/0126234 | A1* | 5/2013 | Ono | H02G 15/08 174/75 R |

FOREIGN PATENT DOCUMENTS

| | | | |
|---|---|---|---|
| JP | 2009-117085 | A | 5/2009 |
| JP | 2009-259558 | A | 11/2009 |
| JP | 2010-073638 | A | 4/2010 |
| JP | 2010-232040 | A | 10/2010 |
| JP | 2011-210593 | A | 10/2011 |
| WO | 2010-024032 | A1 | 3/2010 |
| WO | 2011-096527 | A1 | 8/2011 |
| WO | 2011/122302 | A1 | 10/2011 |
| WO | 2012/018049 | A1 | 2/2012 |

OTHER PUBLICATIONS

Oct. 1, 2013—International Search Report—Intl App PCT/JP2013/070510.

Nov. 13, 2015—(JP) Notification of Reasons for Refusal—App 2012-168155.

Mar. 2, 2016—(CN) Notification of the First Office Action—App 201380040372.0, Eng Tran.

Sep. 5, 2016—(CN) Notification of the Second Office Action—App 201380040372.0.

* cited by examiner

TERMINAL ATTACHED ALUMINUM ELECTRIC WIRE

TECHNICAL FIELD

The present invention relates to a terminal attached aluminum electric wire. In the present specification, both an electric wire made of aluminum and an electric wire made of aluminum alloy are named an aluminum electric wire.

BACKGROUND ART

Typically, copper electric wires are used for wire harnesses that are wired in a vehicle such as an automobile. When these wire harnesses are connected or the wire harness and an in-vehicle apparatus are connected, a terminal is attached to the copper electric wire of the wire harness, and this kind of terminal is typically attached to the copper electric wire by being crimped.

Typically, the terminal, which is crimped to the copper electric wire, includes a bottom plate on which a conductor part of the copper electric wire which is formed by twisting a plurality of copper strands is placed, and a pair of conductor tightening pieces which are provided adjacently to the bottom plate to hold the conductor part which is placed on the bottom plate.

When the pair of conductor tightening pieces are crimped inward, the conductor part of the copper electric wire is sandwiched between the bottom plate and the pair of conductor tightening pieces so that the terminal is crimped to the conductor part of the copper electric wire by this sandwiching.

In recent years, in consideration of the lightweighting of vehicles, and the easiness of material recycling, in addition to the lack of copper resource, it is considered to use aluminum electric wires to replace the copper electric wires. However, an oxide film formed on the surface of aluminum is thicker than that of copper, and for the aluminum electric wire, the contact resistance between the conductor part and the crimped terminal tends to become relatively higher.

Thus, to reduce the contact resistance between the conductor part of the aluminum electric wire and the crimped terminal, a method is adopted to strongly crimp a barrel of the crimped terminal to the conductor part of the aluminum electric wire to raise compression rate of the conductor part of the aluminum electric wire. When this method is used, because the conductor part of the aluminum electric wire is strongly crimped, the oxide film of the strands of the conductor part of the aluminum electric wire is broken and the contact resistance between the conductor part and the crimped terminal of the aluminum electric wire is reduced.

It is known that when water exists at the contact part (crimped part) where different kinds of metals (that is, the aluminum material and the copper material) contact, the two metals (aluminum and copper) dissolve into the water as ions, a potential difference between the aluminum material and the copper material is produced, and electrolytic corrosion occurs.

Thus, when the crimped terminal made of copper or copper alloy is connected to the conductor part of the aluminum electric wire, the crimped part of the conductor part of the aluminum electric wire crimped by the barrel of the crimped terminal is crimped at a high compression rate so that water is prevented from invading the contact portion where the conductor part of the aluminum electric wire and the barrel of the crimped terminal contact, and the occurrence of the electrolytic corrosion can be avoided.

However, even if the conductor part of the aluminum electric wire is crimped by the barrel of the crimped terminal, the waterproofing effect is not perfect. Thus, traditionally, as in a connecting structure disclosed in a patent document 1, insulating coating at the distal end side of an aluminum core line is peeled to expose an aluminum electric wire distal end, and by immersing the aluminum electric wire distal end in molten solder which is molten at approximately 300° C. by using, for example, Sn—Zn solder which is easy to be close to aluminum, coating solder attaches to and coats the surface of the aluminum electric wire distal end.

It is described in this patent document 1 that it is desirable that the coating solder which attaches to the surface of the aluminum electric wire distal end has such a thickness that a break will not occur because of the crimping of the wire barrel.

Further, a terminal metal fitting attached electric wire is disclosed in a patent document 2 for which without using anticorrosive material, the connecting part where an electric wire and a terminal metal fitting is connected is surely prevented from electrolytic corrosion. The terminal metal fitting attached electric wire includes an aluminum electric wire whose metal core line is covered with an insulating coating, a female terminal metal fitting which is made of a metal different from that of the core line, and is provided with a wire barrel which is connected to the aluminum electric wire, a solder seal which is formed of a solder which mainly includes a metal whose ionization tendency is close to that of the female terminal metal fitting, and to which the wire barrel is crimped while the core line, which is exposed by peeling a part of the insulating coating of the aluminum electric wire, is sealed by the solder, and a seal connecting part which connects the insulating coating which is adjacent to the exposed core line and the solder seal while the insulating coating and the solder seal is sealed.

Thus, it is described in this patent document 2 that the solder seal is crimped by the wire barrel in an overlap-crimping manner, and a crimping condition is set so that the solder seal will not break by this crimping.

CITATION LIST

Patent Literature

Patent document 1: WO 2011/096527
Patent document 2: JP-A-2011-210593

SUMMARY OF INVENTION

Technical Problem

According to the connecting structure disclosed in the patent document 1, even if the coating solder which is attached to the surface of the aluminum electric wire distal end is formed to have such a thickness that a break will not occur in the coating solder by the crimping of the wire barrel piece so that the coating solder is crimped uniformly by the wire barrel piece, a break may occur due to the crimping of the wire barrel piece, and there is a problem which is that water may invade from this break to the aluminum electric wire distal end, and electrolytic corrosion would occur.

According to the terminal metal fitting attached electric wire disclosed in the patent document 2, although it is shown that the solder seal is crimped by the wire barrel in an overlap-crimping manner, and the solder seal will not break by this crimping, the associated measures are not shown. If a break occurs when the solder seal is crimped by the wire barrel in the overlap-crimping manner, there is a problem which is that water invades the core line which is exposed by peeling the insulating coating of the aluminum electric wire from the break, and electrolytic corrosion would occur.

The present invention is made in view of the above described circumstances, and the present invention is to provide a terminal attached aluminum electric wire for which even when the conductor part of the aluminum electric wire is crimped by the conductor crimping part of the crimped terminal, at least the solder, which is coated on the conductor part so that the conductor part of the aluminum electric wire is not exposed to external air, near the end of the conductor part is prevented from being broken, and by preventing water from invading the conductor part of the aluminum electric wire, electrolytic corrosion can be prevented from occurring.

Solution to Problem (1) A crimped terminal attached aluminum electric wire in which an insulator of the aluminum electric wire having a conductor part formed by twisting a plurality of strands made of aluminum or aluminum alloy is peeled and a conductor crimping part of the crimped terminal made of copper or copper alloy is crimped and connected to the exposed conductor part so that the distal end side of the conductor part is exposed from the conductor crimping part, wherein the whole outer periphery of the conductor part is coated with solder and a solder coating film is formed, the conductor part which is coated with the solder is placed on the conductor crimping part of the crimped terminal, the conductor crimping part is tightened so that a strongly crimped part where the solder coating film of the conductor part is crimped with such a strength that a break occurs due to the crimping force, and a weakly crimped part at the distal end side of the strongly crimped part where the solder coating film is crimped with such a strength that a break will not occur due to the crimping force are formed, and the conductor part and the conductor crimping part are electrically connected.

(2) In the crimped terminal attached aluminum electric wire according to the configuration (1), at the distal end side of the weakly crimped part, a bell mouse part is formed to be adjacent to the weakly crimped part.

(3) A crimped terminal attached aluminum electric wire in which an insulator of the aluminum electric wire having a conductor part formed by twisting a plurality of strands made of aluminum or aluminum alloy is peeled and a conductor crimping part of the crimped terminal made of copper or copper alloy is crimped to the exposed conductor part and the conductor part is connected so that the distal end side and the base end side of the conductor part are exposed from the conductor crimping part, wherein the whole outer periphery of the conductor part is coated with solder and a solder coating film is formed, the conductor part which is coated with the solder is placed on the conductor crimping part of the crimped terminal, the conductor crimping part is tightened so that a strongly crimped part where the solder coating film of the conductor part is crimped with such a strength that a break occurs due to the crimping force, and weakly crimped parts respectively at the distal end side and the base end side of the strongly crimped part where the solder coating film is crimped with such a strength that a break will not occur due to the crimping force are formed, and the conductor part and the conductor crimping part are electrically connected.

(4) In the crimped terminal attached aluminum electric wire according to the configuration (3), wherein at the distal end side of the weakly crimped part, a bell mouse part is formed to be adjacent to the distal end of the weakly crimped part, and at the base end side of the weakly crimped part, a bell mouse part is formed to be adjacent to the base end of the weakly crimped part.

According to the crimped terminal attached aluminum electric wire described in the above (1), even if the conductor part of the aluminum electric wire is crimped by the conductor crimping part of the crimped terminal, a break will not occur at the solder coating film formed on the conductor part of the aluminum electric wire due to the crimping force of the conductor crimping part at the distal end side of the conductor part of the aluminum electric wire, and water can be prevented from invading the inside of the conductor part of the aluminum electric wire.

According to the crimped terminal attached aluminum electric wire described in the above (2), at the distal end side of the weakly crimped part formed at the conductor crimping part, the bell mouse part is formed to be adjacent to the weakly crimped part. Thus, it can be prevented that an edge is formed at the distal end side of the conductor crimping part when the conductor crimping part is crimped, and the conductor part of the aluminum electric wire can be prevented from being damaged.

According to the crimped terminal attached aluminum electric wire described in the above (3), even if the conductor part of the aluminum electric wire is crimped by the conductor crimping part of the crimped terminal, a break will not occur at the solder coating film formed on the conductor part of the aluminum electric wire due to the crimping force of the conductor crimping part respectively at the distal end side and the base end side of the conductor part of the aluminum electric wire, and water can be prevented from invading the inside of the conductor part of the aluminum electric wire respectively from the distal end side and the based end side of the conductor part of the aluminum electric wire.

According to the crimped terminal attached aluminum electric wire described in the above (4), at the distal end side of the weakly crimped part, the bell mouse part is formed to be adjacent to the distal end of the weakly crimped part, and at the base end side of the weakly crimped part, the bell mouse part is formed to be adjacent to the base end of the weakly crimped part. Thus, it can be prevented that an edge is formed at the distal end side of the conductor crimping part and the base end side of the conductor crimping part when the conductor crimping part is crimped, and the conductor part of the aluminum electric wire can be prevented from being damaged.

The present invention has been briefly described above. Further, details of the present invention will become more apparent after embodiments of the invention described below (hereinafter referred to as "embodiments") are read with reference to the accompanying figures.

DESCRIPTION OF EMBODIMENTS

Below, particular embodiments of the crimped terminal attached aluminum electric wire according to the present invention are described in detail based on the figures.

Embodiment 1

The embodiment 1 of the crimped terminal attached aluminum electric wire according to the present invention is shown in FIGS. 1 to 6.

Figure 1:
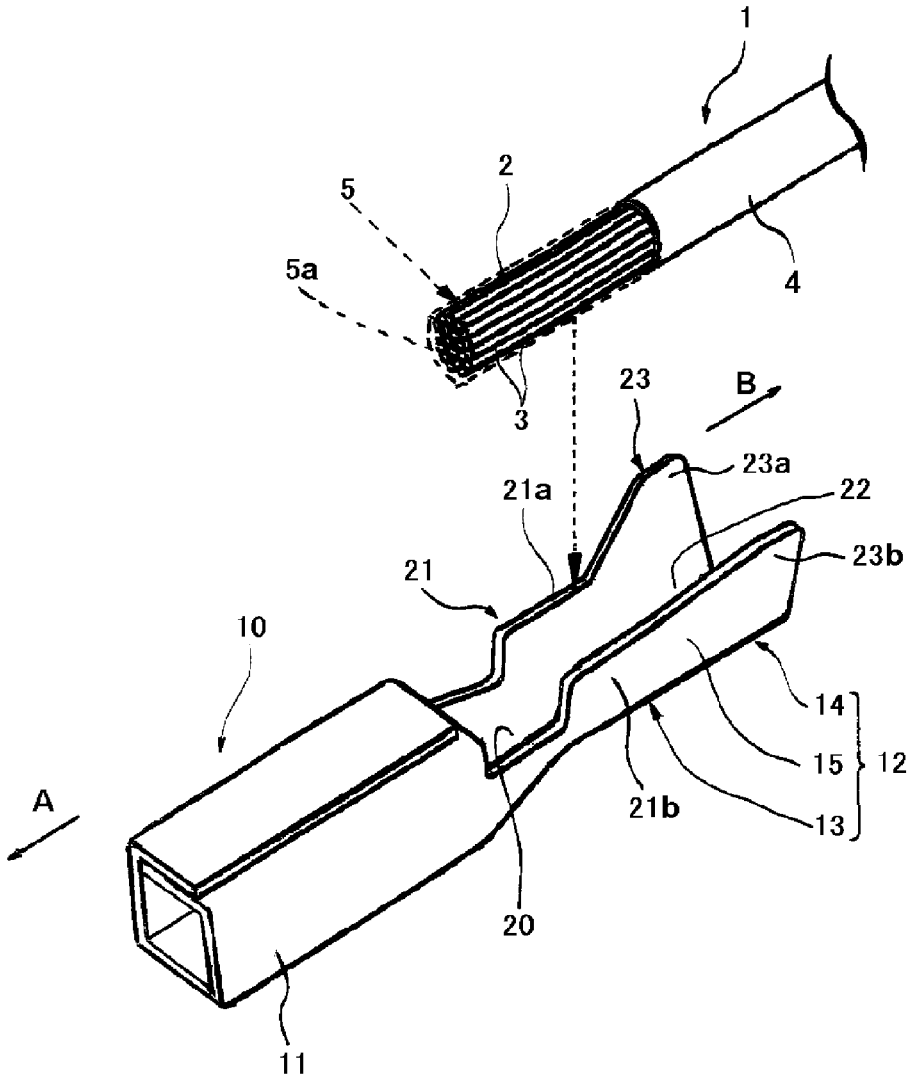
FIG. 1 is an exploded perspective view which shows a crimped terminal attached aluminum electric wire according to an embodiment 1 of the present invention.

As shown in FIG. 1, an aluminum electric wire 1 is constructed by a coated electric wire which has a conductor part 2 which is formed by twisting a plurality of strands 3 made of aluminum or aluminum alloy, and a sheath (insulator) 4 which is formed of an insulating material and circumferentially coats the conductor part 2.

For example, the aluminum alloy, which the aluminum electric wire 1 is formed of, may be an alloy of aluminum and iron. In comparison with a conductor made of aluminum, the conductor made of this alloy is easier to spread and has a higher strength (particularly pulling strength).

At an end part of the aluminum electric wire 1 (the distal end section of the electric wire), a predetermined length of the sheath 4 is removed to expose the conductor part 2, and a crimped terminal 10 is crimped to the end part of the aluminum electric wire 1. As shown with a wavy line in FIG. 2, solder 5*a* is applied to the whole outer periphery of the conductor part 2 to form a solder coating film 5 on the outer periphery of the conductor part 2.

Figure 2:
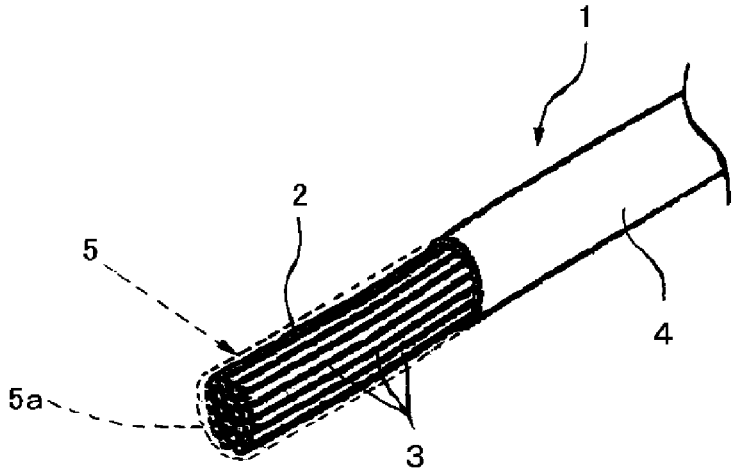
FIG. 2 is a perspective view which shows an aluminum electric wire whose conductor part, which is exposed by peeling an insulator of the crimped terminal attached aluminum electric wire shown in FIG. 1, is coated by solder.

As a method of forming the solder coating film 5 on the whole outer periphery of the conductor part 2 by applying and coating the solder 5*a* as shown with the broken line in FIG. 2, a method of immersing the conductor part 2 of the aluminum electric wire 1 in a container where molten solder is received to coat the solder 5*a* is adopted.

The solder coating film 5 which is formed on the outer periphery of the conductor part 2 of the aluminum electric wire 1 may be formed by immersing the conductor part 2 of the aluminum electric wire 1 in the solder 5*a* which is melted by supersonic wave vibration to perform soldering.

In this way, as shown in FIG. 2, when the solder 5*a* is applied on the outer periphery of the conductor part 2 of the aluminum electric wire 1 to form the solder coating film 5, an area from the conductor part 2 of the exposed aluminum electric wire 1 until the sheath 4 which is adjacent to the conductor part 2 is covered by the solder coating film 5. Thus, since the conductor part 2 of the aluminum electric wire 1 is covered by the solder coating film 5, the exposed conductor part 2 is waterproofed. Because the crimped terminal 10 is crimped to the conductor part 2, the conductor part 2 and the crimped terminal 10 are electrically connected.

As shown in FIG. 1, the crimped terminal 10 is formed by press-molding (including bending) a board material made of conductive metal such as copper alloy. The distal end of the crimped terminal 10 is provided with a terminal connecting part 11 which is connected with a mating terminal (not illustrated), and the base end of the crimped terminal 10 is provided with an electric wire holding part 12 which holds the aluminum electric wire 1.

The electric wire holding part 12 includes a conductor crimping part 13, which holds the distal end section of the conductor part 2 of the aluminum electric wire 1, at the distal end side, and a sheath holding part 14, which holds the sheath 4 of the aluminum electric wire 1, at the base end side.

A common bottom plate is formed continuously from a bottom plate 20 of the conductor crimping part 13 to a bottom plate 22 of the sheath holding part 14. Furthermore, between conductor tightening pieces 21 of the conductor crimping part 13 and sheath tightening pieces 23 of the sheath holding part 14, as walls that connect the conductor tightening pieces 21 and the sheath tightening pieces 23, a pair of covering walls 15 is provided which deform plastically to cover the space between the conductor crimping part 13 and the sheath holding part 14 with the tightening of the conductor tightening pieces 21 and the sheath tightening pieces 23.

The crimped terminal 10 shown in FIG. 1 is a distal-end-exposed one, for which the distal end side of the conductor part 2 is exposed from the conductor crimping part 13.

Figure 3:
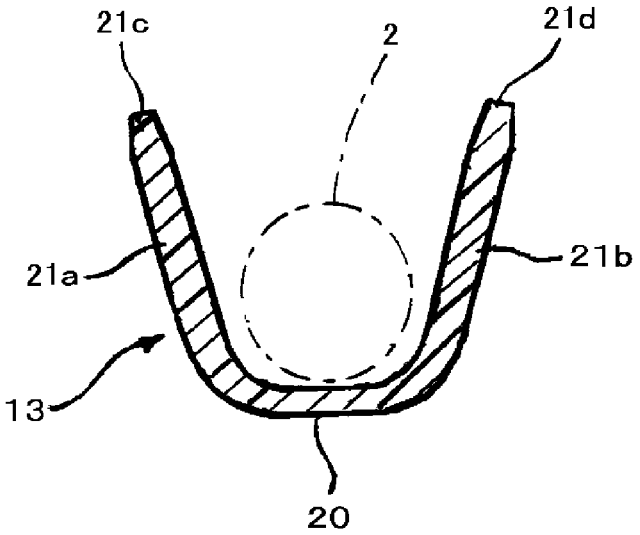
FIG. 3 is a cross-sectional view which shows that the aluminum electric wire, whose conductor part which is exposed by peeling the insulator of the aluminum electric wire shown in FIG. 2 is coated by solder, is placed on a conductor crimping part.

As shown in FIG. 3, the conductor crimping part 13 includes the bottom plate 20 and the pair of conductor tightening pieces 21 which include a conductor tightening piece 21*a* and a conductor tightening piece 21*b*. The conductor crimping part 13 is molded into a roughly U shape in a section perpendicular to the longitudinal direction of the crimped terminal 10, and on the bottom plate 20, the conductor part 2 of the aluminum electric wire 1 is placed.

The sheath holding part 14 includes the bottom plate 22 and the pair of the sheath tightening pieces 23 which include a sheath tightening piece 23*a* and a sheath tightening piece 23*b*. The sheath holding part 14 is molded into a roughly U shape in a section perpendicular to the longitudinal direction of the crimped terminal 10, and on the bottom plate 22, a part of the aluminum electric wire 1 at the end which is covered by the sheath 4 is placed.

Figure 4:
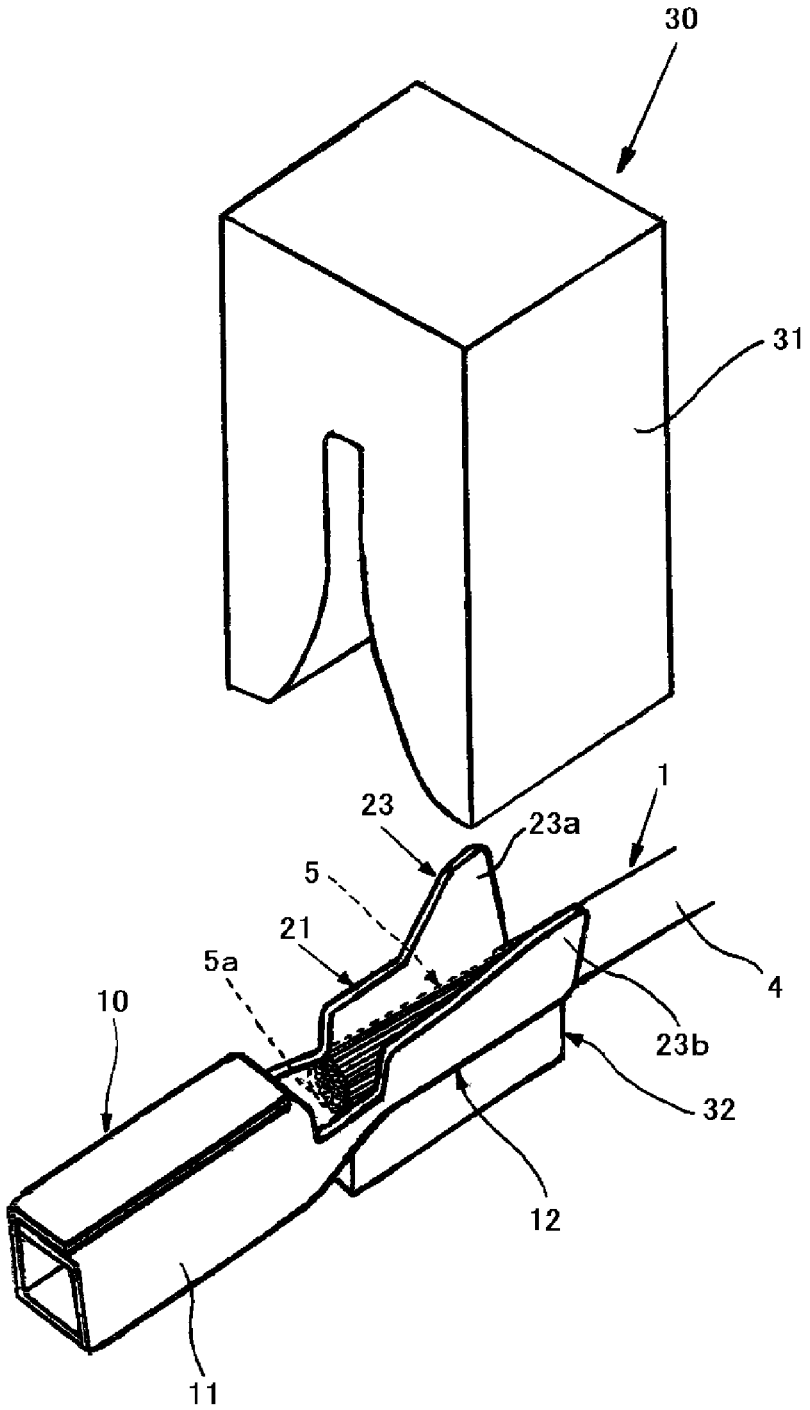
FIG. 4 is a perspective view which shows that the aluminum electric wire shown in FIG. 3 is placed on the conductor crimping part of a crimped terminal, and the aluminum electric wire is crimped to the crimped terminal by an exclusive crimping machine.

The conductor crimping part 13 is formed of the bottom plate 20 and the pair of conductor tightening pieces 21*a*, 21*b* which stand up from two (left and right) side edges of the bottom plate 20 to extend upward. As shown in FIG. 4, the conductor part 2 of the aluminum electric wire 1 is positioned on the conductor crimping part 13 of the crimped terminal 10, and the conductor part 2 of the aluminum electric wire 1 is crimped and connected to the crimped terminal 10 by an exclusive crimping machine 30.

When the conductor part 2 of the aluminum electric wire 1 is crimped to the crimped terminal 10 by the crimping machine 30, the pair of conductor tightening pieces 21*a*, 21*b* are respectively bent inward to enclose the conductor part 2 of the aluminum electric wire 1, and after distal ends 21*c*, 21*d* of the pair of conductor tightening pieces 21*a*, 21*b* positionally approach toward the bottom plate 20 while the outer surfaces of the pair of conductor tightening pieces 21*a*, 21*b* rub each other and are joined together, the conductor tightening pieces 21*a*, 21*b* are bent toward the lower side in the alignment direction (horizontal direction) to cut into the conductor part 2 of the aluminum electric wire 1.

The exclusive crimping machine 30 includes a tightening head which includes an upper crimping head 31 and a lower crimping head 32.

Figure 5:
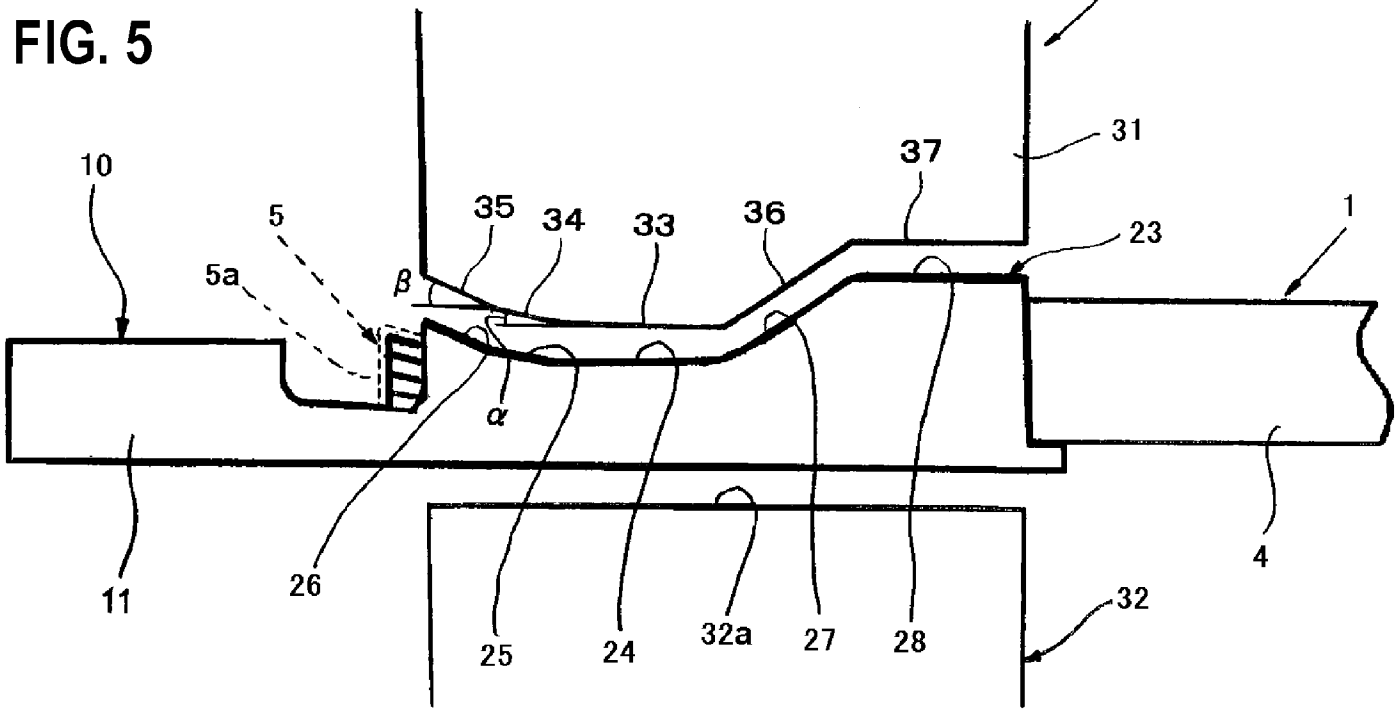
FIG. 5 is a side view which shows that the conductor crimping part of the crimped terminal on which the aluminum electric wire shown in FIG. 4 is placed is crimped and tightened by the exclusive crimping machine.

The crimping surface, which faces the electric wire holding part 12 of the crimped terminal 10, of the upper crimping head 31 is provided with steps, as shown in FIG. 5. That is, the upper crimping head 31 of the crimping machine 30 is provided with a strongly crimped part forming part 33 which tightens the center of the conductor tightening pieces 21 of the crimped terminal 10 with a strong crimping force to form a strongly crimped part 24. At the distal end side of the strongly crimped part forming part 33, a weakly crimped part forming part 34 is provided which tightens with a crimping force that is weaker than that of the strongly crimped part forming part 33 to form a weakly crimped part 25.

When the conductor tightening pieces 21 of the crimped terminal 10 are tightened by the weakly crimped part forming part 34 together with the strongly crimped part forming part 33, the weakly crimped part forming part 34 has such a tightening force (crimping force) that a break will not occur in the solder coating film 5 which is formed on the surface of the conductor part 2 of the aluminum electric wire 1.

Therefore, when the conductor tightening pieces 21 of the crimped terminal 10 are tightened by the weakly crimped part forming part 34 together with the strongly crimped part forming part 33, the tightening force (crimping force) has such a magnitude that a break will not occur in the solder coating film 5 which is formed on the surface of the conductor part 2 of the aluminum electric wire 1.

That is, when the conductor tightening pieces 21 of the crimped terminal 10 are tightened by the upper crimping head 31 of the exclusive crimping machine 30, even if a break occurs in the solder coating film 5 which is formed on the surface of the conductor part 2 of the aluminum electric wire 1 because of the strongly crimped part forming part 33, a break will not occurs in the solder coating film 5 which is formed on the surface of the conductor part 2 of the aluminum electric wire 1 because of the weakly crimped part forming part 34.

The setting of the magnitudes of the crimping force of the strongly crimped part forming part 33 and the crimping force of the weakly crimped part forming part 34 is performed by changing the angle between the bottom 16 of the conductor tightening pieces 21 in the crimped terminal 10 and the crimping surface of the strongly crimped part forming part 33 and the angle between the bottom 16 of the conductor tightening pieces 21 in the crimped terminal 10 and the crimping surface of the weakly crimped part forming part 34.

The strongly crimped part forming part 33 is formed to be substantially parallel to the bottom 16 of the conductor tightening pieces 21 in the crimped terminal 10. In contrast, the weakly crimped part forming part 34 is formed to have an expansion with a predetermined angle ($\alpha$) relative to the crimping surface of the strongly crimped part forming part 33. In this way, the weakly crimped part forming part 34 is so constructed that, by having the expansion with a predetermined angle ($\alpha$) relative to the crimping surface of the strongly crimped part forming part 33, when the conductor tightening pieces 21 of the crimped terminal 10 are tightened by the upper crimping head 31 of the exclusive crimping machine 30, even if the tightening is performed with the same crimping force, it is possible to have a difference between the crimping force of the strongly crimped part forming part 33 and the crimping force of the weakly crimped part forming part 34.

At the distal end side of the weakly crimped part forming part 34, a bell mouse part forming part 35 is provided to be adjacent to the distal end side of the weakly crimped part forming part 34. The bell mouse part forming part 35 serves to form a bell mouse part 26 at the distal end of the conductor tightening pieces 21 of the crimped terminal 10. When the conductor tightening pieces 21 of the crimped terminal 10 are tightened, if the conductor tightening pieces 21 are tightened with a uniform shape, an edge in the conductor tightening pieces 21 would be formed. The edge formed at the distal end of the conductor tightening pieces 21 would damage the conductor part 2 of the aluminum electric wire 1 which is softer than the crimped terminal 10. Thus, to prevent the conductor part 2 of the aluminum electric wire 1 from being damaged by the edge, the bell mouse part 26 is formed to have an expansion outward to make the end of the conductor tightening pieces 21 of the crimped terminal 10 resemble the shape of a bell.

Therefore, the setting of the magnitudes of the crimping force of the weakly crimped part forming part 34 and the crimping force of the bell mouse part forming part 35 is performed by changing the angle between the bottom 16 of the conductor tightening pieces 21 in the crimped terminal 10 and the crimping surface of the weakly crimped part forming part 34 and the angle between the bottom 16 of the conductor tightening pieces 21 in the crimped terminal 10 and the crimping surface of the weakly crimped part forming part 34.

The weakly crimped part forming part 34 is formed to have a predetermined angle ($\alpha$) relative to the bottom 16 of the conductor tightening pieces 21 in the crimped terminal 10. In contrast, the bell mouse part forming part 35 is formed to have an expansion with a predetermined angle ($\beta$) relative to the crimping surface of the weakly crimped part forming part 34.

The predetermined angle ($\alpha$) of the weakly crimped part forming part 34 and the predetermined angle ($\beta$) of the bell mouse part forming part 35 have the following relationship, $\beta>\alpha$.

Thus, because the angle of the crimping surface of the bell mouse part forming part 35 that faces the bottom 16 of the conductor tightening pieces 21 in the crimped terminal 10 is larger than the predetermined angle (α) of the expansion of the crimping surface of the weakly crimped part forming part 34 that faces the bottom 16 of the conductor tightening pieces 21 in the crimped terminal 10, the conductor tightening pieces 21 of the crimped terminal 10 are crimped by the bell mouse part forming part 35 more weakly than the weakly crimped part forming part 34, and it is prevented that an edge is formed in the conductor tightening pieces 21.

At the base end side of the strongly crimped part forming part 33, a ramp part forming part 36 is provided which is adjacent to the strongly crimped part forming part 33 and which forms a ramp part 27 which crimps a part from the conductor part 2 to the sheath 4 of the aluminum electric wire 1, and a resin crimping part forming part 37 is provided which is adjacent to the ramp part forming part 36 and which crimps the sheath 4 and forms a resin crimping part 28.

The lower crimping head 32 is formed with a flat crimping surface 32*a* which faces upward. Therefore, when the conductor tightening pieces 21 of the conductor crimping part 13 in the crimped terminal 10 and the sheath tightening pieces 23 of the sheath holding part 14 in the crimped terminal 10 are tightened by the upper crimping head 31 and the lower crimping head 32, a terminal attached aluminum electric wire 100 as shown in FIG. 6 is formed.

Figure 6:
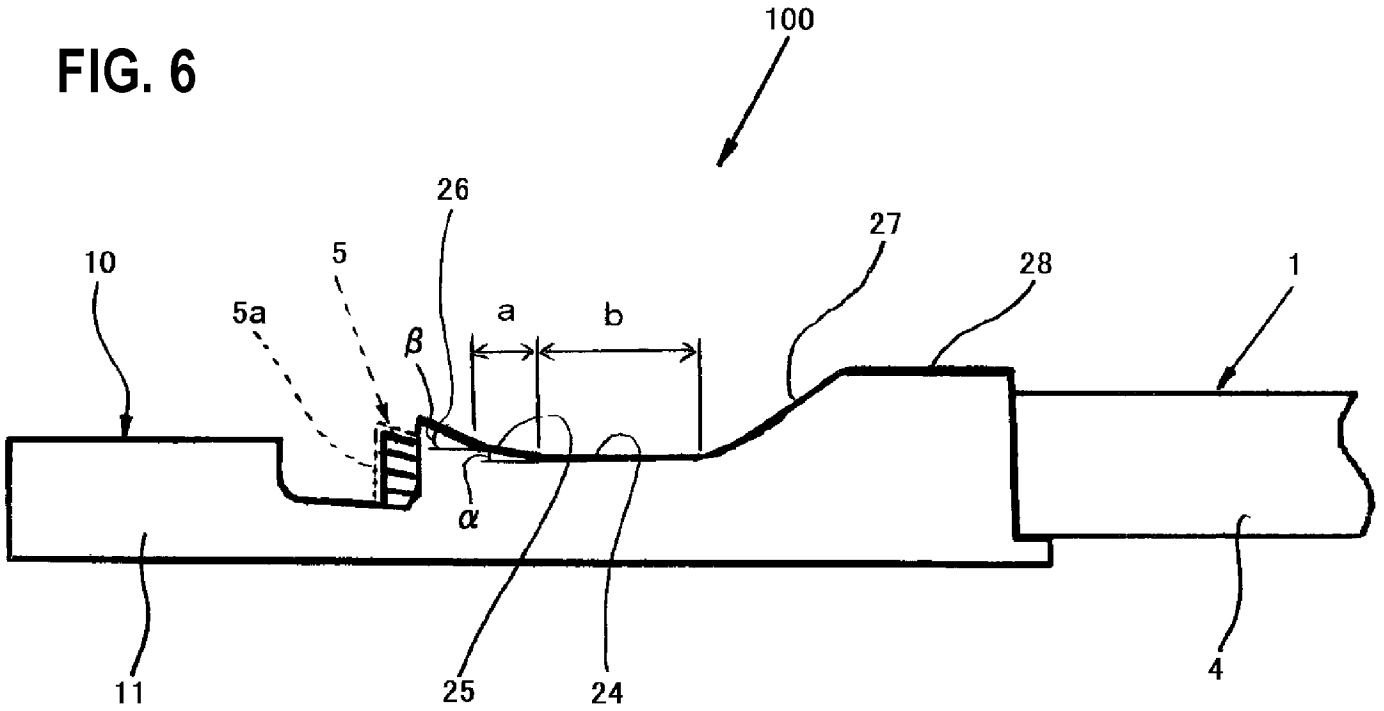
FIG. 6 is a side view to indicate the tightening strength of the conductor crimping part of the crimped terminal attached aluminum electric wire after the conductor crimping part of the crimped terminal on which the aluminum electric wire shown in FIG. 5 is placed is crimped and tightened by the exclusive crimping machine.

As shown in FIG. 6, the crimped terminal 10 of the terminal attached aluminum electric wire 100 which is tightened by the upper crimping head 31 and the lower crimping head 32 is provided with the electric wire holding part 12 which holds the aluminum electric wire 1 at the base end, and the electric wire holding part 12 is provided with the conductor crimping part 13 which holds the distal end section of the conductor part 2 of the aluminum electric wire 1, at the distal end side, and the sheath holding part 14 which holds the sheath 4 of the aluminum electric wire 1, at the base end side.

The electric wire holding part 12 of the crimped terminal 10 is provided with the strongly crimped part 24 which is tightened with a strong crimping force, the weakly crimped part 25 which is tightened with a crimping force that is weaker than that of the strongly crimped part 24, the bell mouse part 26 which is tightened with a crimping force that is weaker than that of the weakly crimped part 25, the ramp part 27 which is formed by tightening the part from the conductor part 2 to the sheath 4 of the aluminum electric wire 1, and the resin crimping part 28 which is formed by tightening a part of the sheath 4.

The strongly crimped part 24 has the length of a distance b to match the shape of the conductor part 2 of the aluminum electric wire 1, and is tightened with a strong crimping force. The crimping force of the strongly crimped part 24 has such a magnitude that a break occurs in the solder coating film 5 which is formed on the surface of the conductor part 2 of the aluminum electric wire 1 when the strongly crimped part forming part 33 is tightened.

The length of the distance b is such a length that when the strongly crimped part forming part 33 is tightened, the solder coating film 5 on the surface of the conductor part 2 is broken and the connection of the conductor part 2 of the aluminum electric wire 1 and the conductor tightening pieces 21 of the crimped terminal 10 can be sufficiently maintained.

The weakly crimped part 25 has an expansion with a predetermined angle (α) outward relative to the strongly crimped part 24, and is tightened with a crimping force that is weaker than the tightening force of the strongly crimped part 24 in the length of a distance a. The crimping force of the weakly crimped part 25 has such a magnitude that a break will not occur in the solder coating film 5 which is formed on the surface of the conductor part 2 of the aluminum electric wire 1 when the weakly crimped part forming part 34 is tightened.

The length of the distance a is such a length that when the weakly crimped part forming part 34 is tightened, the solder coating film 5 on the surface of the conductor part 2 is kept unbroken and the waterproofness of the conductor part 2 of the aluminum electric wire 1 can be maintained.

The bell mouse part 26 has an expansion with a predetermined angle (β) outward relative to the weakly crimped part 25, and is tightened with a crimping force that is further weaker than the tightening force of the weakly crimped part 25. The crimping force of the bell mouse part 26 is such a crimping force that when the bell mouse part forming part 35 is tightened, an edge at the bell mouse part 26 will not be produced by the bell mouse part forming part 35.

The predetermined angle (α) of the weakly crimped part 25 and the predetermined angle (β) of the bell mouse part 26 has the following relationship, $\beta>\alpha$.

The predetermined angle (α) of the weakly crimped part 25 and the predetermined angle (β) of the bell mouse part 26 are commonly formed by the upper crimping head 31.

At the base end side of the strongly crimped part 24 in the electric wire holding part 12 of the crimped terminal 10, the ramp part 27 which is formed by tightening the part from the conductor part 2 to the sheath 4 of the aluminum electric wire 1, and the resin crimping part 28 which is formed by tightening a part of the sheath 4 of the aluminum electric wire 1 are provided.

Thus, according to the present embodiment 1, since the strongly crimped part 24 of the crimped terminal 10 made of copper or copper ally is strongly crimped, a good conduction between the conductor part 2 of the aluminum electric wire 1 and the strongly crimped part 24 can be maintained. Further, the solder coating film 5 which is formed on the surface of the conductor part 2 of the aluminum electric wire 1 at the weakly crimped part 25 and the bell mouse part 26 of the crimped terminal 10 is kept unbroken, water can be prevented from invading for a long term.

Further, according to the present embodiment 1, because it is not necessary to coat anticorrosion material, electrolytic corrosion at the connecting portion where the aluminum electric wire 1 and the crimped terminal 10 are connected can be prevented at a low cost.

Embodiment 2

Figure 7:
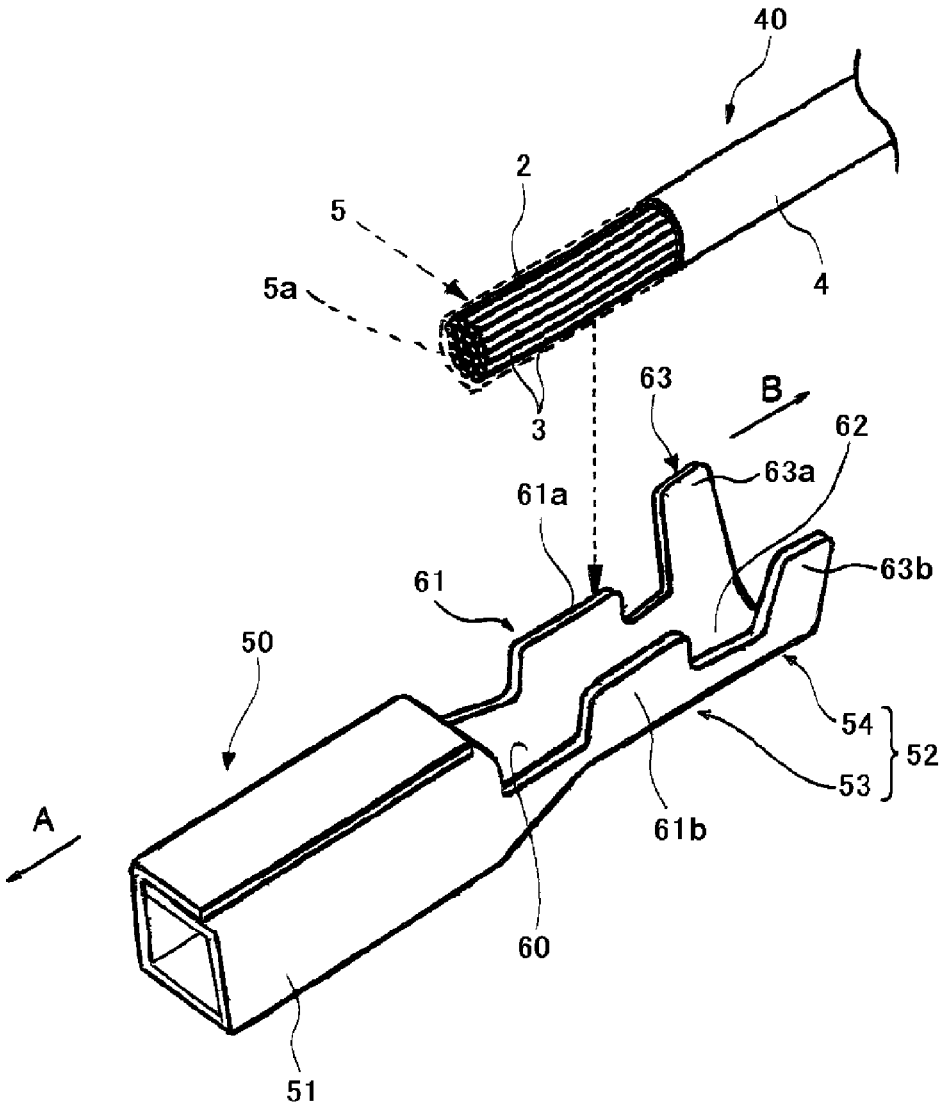
FIG. 7 is an exploded perspective view which shows a crimped terminal attached aluminum electric wire according to an embodiment 2 of the present invention.
Figure 8:
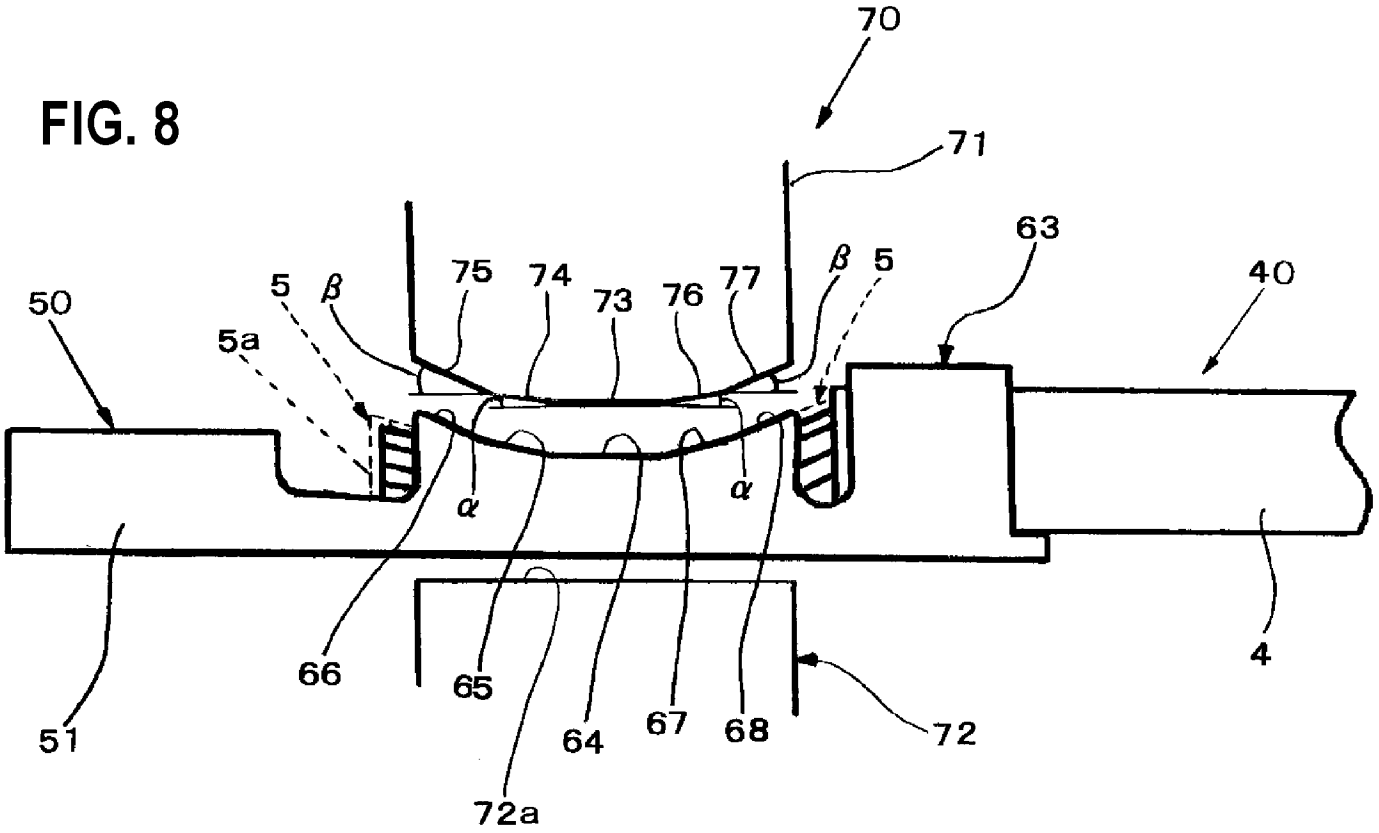
FIG. 8 is a side view which shows that the conductor crimping part of the crimped terminal on which the aluminum electric wire shown in FIG. 7 is placed is crimped and tightened by an exclusive crimping machine.
Figure 9:
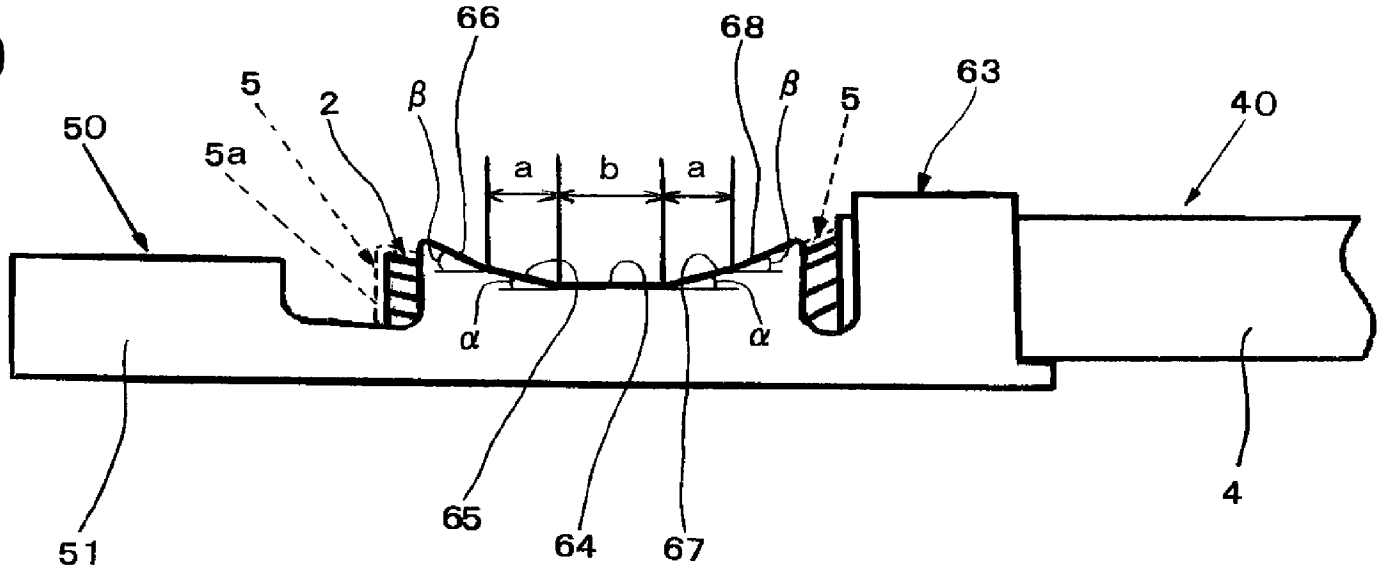
FIG. 9 is a side view to indicate the tightening strength of the conductor crimping part of the crimped terminal attached aluminum electric wire after the conductor crimping part of the crimped terminal on which the aluminum electric wire shown in FIG. 8 is placed is crimped and tightened by the exclusive crimping machine.

The embodiment 2 of the crimped terminal attached aluminum electric wire according to the present invention is shown in FIGS. 7 to 9.

The embodiment 2 shown in FIGS. 7 to 9 is different from the embodiment 1 shown in FIGS. 1 to 6 in that while the embodiment 1 shown in FIGS. 1 to 6 is such a crimped terminal attached aluminum electric wire that the distal end side of the conductor part is exposed from the conductor crimping part of the crimped terminal, the embodiment 2 shown in FIGS. 7 to 9 is such a crimped terminal attached aluminum electric wire that the distal end side and the base end side of the conductor part are exposed from the conductor crimping part of the crimped terminal.

As shown in FIG. 7, an aluminum electric wire 40 is constructed by a coated electric wire which has a conductor part 2 which is formed by twisting a plurality of strands 3 made of aluminum or aluminum alloy, and a sheath 4 which is formed of an insulating material and circumferentially coats the conductor part 2.

The aluminum electric wire 40 shown in FIG. 7 has the same construction as that of the aluminum electric wire 1 shown in FIG. 1, and at one end part (distal end section of the electric wire), a predetermined length of the sheath 4 is removed to expose the conductor part 2.

As shown with a wavy line in FIG. 7, solder 5*a* is applied to the whole outer periphery of the conductor part 2 to form a solder coating film 5 on the outer periphery of the conductor part 2.

In this way, as shown in FIG. 7, when the solder 5*a* is applied on the outer periphery of the conductor part 2 of the aluminum electric wire 40 to form the solder coating film 5, an area from the conductor part 2 of the exposed aluminum electric wire 40 until the sheath 4 which is adjacent to the conductor part 2 is covered by the solder coating film 5. Thus, since the conductor part 2 of the aluminum electric wire 40 is covered by the solder coating film 5, the exposed conductor part 2 is waterproofed. Because the crimped terminal 50 is crimped to the conductor part 2, the conductor part 2 and the crimped terminal 50 are electrically connected.

As shown in FIG. 7, the crimped terminal 50 is formed by press-molding (including bending) a board material made of conductive metal such as copper alloy. The distal end of the crimped terminal 50 is provided with a terminal connecting part 51 which is connected with a mating terminal (not illustrated), and the base end of the crimped terminal 50 is provided with an electric wire holding part 52 which holds the aluminum electric wire 40.

The electric wire holding part 52 includes a conductor crimping part 53, which holds the distal end section of the conductor part 2 of the aluminum electric wire 40, at the distal end side and a sheath holding part 54, which holds the sheath 4 of the aluminum electric wire 40, at the base end side.

A common bottom plate is formed continuously from a bottom plate 60 of the conductor crimping part 53 to a bottom plate 62 of the sheath holding part 54.

The crimped terminal 50 shown in FIG. 7 has such a construction that the distal end side and the base end side of the conductor part 2 are exposed from the conductor crimping part 53 of the crimped terminal 50.

As shown in FIG. 7, the conductor crimping part 53 includes the bottom plate 60 and the pair of conductor tightening pieces 61 which include a conductor tightening piece 61*a* and a conductor tightening piece 61*b*. The conductor crimping part 53 is molded into a roughly U shape in a section perpendicular to the longitudinal direction of the crimped terminal 50, and on the bottom plate 60, the conductor part 2 of the aluminum electric wire 40 is placed.

The sheath holding part 54 includes the bottom plate 62 and the pair of the sheath tightening pieces 63 which include a sheath tightening piece 63*a* and a sheath tightening piece 63*b*. The sheath holding part 54 is molded into a roughly U shape in a section perpendicular to the longitudinal direction of the crimped terminal 50, and on the bottom plate 62, a part of the aluminum electric wire 40 at the end which is covered by the sheath 4 is placed.

The conductor crimping part 53 is formed of the bottom plate 60 and a pair of conductor tightening pieces 61*a*,61*b* which stand up from two (left and right) side edges of the bottom plate 60 to extend upward. The conductor part 2 of the aluminum electric wire 40 is positioned on the conductor crimping part 53 of the crimped terminal 50, and the conductor part 2 of the aluminum electric wire 40 is crimped and connected to the crimped terminal 50 by an exclusive crimping machine 70.

As shown in FIG. 8, the exclusive crimping machine 70 includes a tightening head which includes an upper crimping head 71 and a lower crimping head 72.

The crimping surface, which faces the electric wire holding part 52 of the crimped terminal 50, of the upper crimping head 71 is provided with steps, as shown in FIG. 5. That is, the upper crimping head 71 of the crimping machine 30 is provided with a strongly crimped part forming part 73 which tightens the center of the conductor tightening pieces 61 of the crimped terminal 50 with a strong crimping force to form a strongly crimped part 64. At the distal end side of the strongly crimped part forming part 73, a weakly crimped part forming part 74 is provided which tightens with a crimping force that is weaker than that of the strongly crimped part forming part 73 to form a weakly crimped part 65.

When the conductor tightening pieces 61 of the crimped terminal 50 are tightened by the weakly crimped part forming part 74 together with the strongly crimped part forming part 73, the weakly crimped part forming part 34 has such a tightening force (crimping force) that a break will not occur in the solder coating film 5 which is formed on the surface of the conductor part 2 of the aluminum electric wire 40.

Therefore, when the conductor tightening pieces 61 of the crimped terminal 50 are tightened by the weakly crimped part forming part 74 together with the strongly crimped part forming part 73, the tightening force (crimping force) has such a magnitude that a break will not occur in the solder coating film 5 which is formed on the surface of the conductor part 2 of the aluminum electric wire 40.

That is, when the conductor tightening pieces 61 of the crimped terminal 50 are tightened by the upper crimping head 71 of the exclusive crimping machine 70, even if a break occurs in the solder coating film 5 which is formed on the surface of the conductor part 2 of the aluminum electric wire 40 because of the strongly crimped part forming part 73, a break will not occurs in the solder coating film 5 which is formed on the surface of the conductor part 2 of the aluminum electric wire 40 because of the weakly crimped part forming part 74.

The setting of the magnitudes of the crimping force of the strongly crimped part forming part 73 and the crimping force of the weakly crimped part forming part 74 is performed by changing the angle between the bottom 56 of the conductor tightening pieces 61 in the crimped terminal 50 and the crimping surface of the strongly crimped part forming part 73 and the angle between the bottom 56 of the conductor tightening pieces 61 in the crimped terminal 50 and the crimping surface of the weakly crimped part forming part 74.

The strongly crimped part forming part 73 is formed to be substantially parallel to the bottom 56 of the conductor tightening pieces 61 in the crimped terminal 50. In contrast, the weakly crimped part forming part 74 is formed to have an expansion with a predetermined angle ($\alpha$) relative to the crimping surface of the strongly crimped part forming part 73. In this way, the weakly crimped part forming part 74 is so constructed that, by having the expansion with a predetermined angle ($\alpha$) relative to the crimping surface of the strongly crimped part forming part 73, when the conductor tightening pieces 61 of the crimped terminal 50 are tightened by the upper crimping head 71 of the exclusive crimping machine 70, even if the tightening is performed with the same crimping force, it is possible to have a difference between the crimping force of the strongly crimped part forming part 73 and the crimping force of the weakly crimped part forming part 74.

At the distal end side of the weakly crimped part forming part 74, a bell mouse part forming part 75 is provided to be adjacent to the distal end side of the weakly crimped part forming part 74. The bell mouse part forming part 75 serves to form a bell mouse part 66 at the distal end of the conductor tightening pieces 61 of the crimped terminal 50. When the conductor tightening pieces 61 of the crimped terminal 50 are tightened, if the conductor tightening pieces 61 are tightened with a uniform shape, an edge in the conductor tightening pieces 61 would be formed. The edge formed at the distal end of the conductor tightening pieces 61 would damage the conductor part 2 of the aluminum electric wire 40 which is softer than the crimped terminal 50. Thus, to prevent the conductor part 2 of the aluminum electric wire 40 from being damaged by the edge, the bell mouse part 66 is formed to have an expansion outward to make the end of the conductor tightening pieces 61 of the crimped terminal 50 resemble the shape of a bell.

Therefore, the setting of the magnitudes of the crimping force of the weakly crimped part forming part 74 and the crimping force of the bell mouse part forming part 75 is performed by changing the angle between the bottom 56 of the conductor tightening pieces 61 in the crimped terminal 50 and the crimping surface of the weakly crimped part forming part 74 and the angle between the bottom 56 of the conductor tightening pieces 61 in the crimped terminal 50 and the crimping surface of the bell mouse part forming part 75.

The weakly crimped part forming part 74 is formed to have a predetermined angle ($\alpha$) relative to the bottom 56 of the conductor tightening pieces 61 in the crimped terminal 50. In contrast, the bell mouse part forming part 75 is formed to have an expansion with a predetermined angle ($\beta$) relative to the crimping surface of the weakly crimped part forming part 74.

The predetermined angle ($\alpha$) of the weakly crimped part forming part 74 and the predetermined angle ($\beta$) of the bell mouse part forming part 75 have the following relationship, $\beta>\alpha$.

Thus, because the angle of the crimping surface of the bell mouse part forming part 75 that faces the bottom 56 of the conductor tightening pieces 61 in the crimped terminal 50 is larger than the predetermined angle ($\alpha$) of the expansion of the crimping surface of the weakly crimped part forming part 74 that faces the bottom 56 of the conductor tightening pieces 61 in the crimped terminal 50, the conductor tightening pieces 61 of the crimped terminal 50 are crimped by the bell mouse part forming part 75 more weakly than the weakly crimped part forming part 74, and it is prevented that an edge is formed in the conductor tightening pieces 61.

At the base end side of the strongly crimped part forming part 73, a weakly crimped part forming part 76 is provided which tightens with a crimping force that is weaker than that of the strongly crimped part forming part 73 to form a weakly crimped part 67. Like the weakly crimped part forming part 74, when the conductor tightening pieces 61 of the crimped terminal 50 are tightened by the weakly crimped part forming part 76 together with the strongly crimped part forming part 73, the weakly crimped part forming part 76 has such a tightening force (crimping force) that a break will not occur in the solder coating film 5 which is formed on the surface of the conductor part 2 of the aluminum electric wire 40.

Therefore, when the conductor tightening pieces 61 of the crimped terminal 50 are tightened by the upper crimping head 71 of the exclusive crimping machine 70, even if a break occurs in the solder coating film 5 which is formed on the surface of the conductor part 2 of the aluminum electric wire 40 because of the strongly crimped part forming part 73, a break will not occurs in the solder coating film 5 which is formed on the surface of the conductor part 2 of the aluminum electric wire 40 because of the weakly crimped part forming part 76.

The setting of the magnitudes of the crimping force of the strongly crimped part forming part 73 and the crimping force of the weakly crimped part forming part 76, like the setting of the magnitudes of the crimping force of the strongly crimped part forming part 73 and the crimping force of the weakly crimped part forming part 74, is performed by changing the angle between the bottom 56 of the conductor tightening pieces 61 in the crimped terminal 50 and the crimping surface of the strongly crimped part forming part 73 and the angle between the bottom 56 of the conductor tightening pieces 61 in the crimped terminal 50 and the crimping surface of the weakly crimped part forming part 76.

That is, the weakly crimped part forming part 76 is formed to have an expansion with a predetermined angle ($\alpha$) relative to the crimping surface of the strongly crimped part forming part 73. The weakly crimped part forming part 76 is so constructed that, by having the expansion with a predetermined angle ($\alpha$) relative to the crimping surface of the strongly crimped part forming part 73, when the conductor tightening pieces 61 of the crimped terminal 50 are tightened by the upper crimping head 71 of the exclusive crimping machine 70, even if the tightening is performed with the same crimping force, it is possible to have a difference between the crimping force of the strongly crimped part forming part 73 and the crimping force of the weakly crimped part forming part 76.

At the base end side of the weakly crimped part forming part 76, a bell mouse part forming part 77 is provided to be adjacent to the base end side of the weakly crimped part forming part 76. The bell mouse part forming part 77, like the bell mouse part forming part 75, is formed to have an expansion outward to make the end of the conductor tightening pieces 61 of the crimped terminal 50 resemble the shape of a bell.

Therefore, the setting of the magnitudes of the crimping force of the weakly crimped part forming part 76 and the crimping force of the bell mouse part forming part 77 is performed by changing the angle between the bottom 56 of the conductor tightening pieces 61 in the crimped terminal 50 and the crimping surface of the weakly crimped part forming part 76 and the angle between the bottom 56 of the conductor tightening pieces 61 in the crimped terminal 50 and the crimping surface of the bell mouse part forming part 77.

The weakly crimped part forming part 76 is formed to have a predetermined angle ($\alpha$) relative to the bottom 56 of the conductor tightening pieces 61 in the crimped terminal 50. In contrast, the bell mouse part forming part 77 is formed to have an expansion with a predetermined angle ($\beta$) relative to the crimping surface of the weakly crimped part forming part 74.

The predetermined angle ($\alpha$) of the weakly crimped part forming part 76 and the predetermined angle ($\beta$) of the bell mouse part forming part 77 have the following relationship, $\beta>\alpha$.

Thus, because the angle of the crimping surface of the bell mouse part forming part 77 that faces the bottom 56 of the conductor tightening pieces 61 in the crimped terminal 50 is larger than the predetermined angle (α) of the expansion of the crimping surface of the weakly crimped part forming part 74 that faces the bottom 56 of the conductor tightening pieces 61 in the crimped terminal 50, the conductor tightening pieces 61 of the crimped terminal 50 are crimped by the bell mouse part forming part 75 more weakly than the weakly crimped part forming part 76, and it is prevented that an edge is formed in the conductor tightening pieces 61.

The lower crimping head 72 is formed with a flat crimping surface 72*a* which faces upward. Therefore, when the conductor tightening pieces 61 of the conductor crimping part 53 in the crimped terminal 50 and the sheath tightening pieces 63 of the sheath holding part 54 in the crimped terminal 50 are tightened by the upper crimping head 71 and the lower crimping head 72, a terminal attached aluminum electric wire 200 as shown in FIG. 9 is formed.

As shown in FIG. 9, the electric wire holding part 52 of the crimped terminal 50 of the terminal attached aluminum electric wire 200 which is tightened by the upper crimping head 71 and the lower crimping head 72 is provided with the strongly crimped part 64 which is tightened with a strong crimping force, the weakly crimped part 65 which is tightened with a crimping force that is weaker than that of the strongly crimped part 64, the bell mouse part 66 which is tightened with a crimping force that is weaker than that of the weakly crimped part 65, a weakly crimped part 67 which is tightened with a crimping force that is weaker than that of the strongly crimped part 64, a bell mouse part 68 which is tightened with a crimping force that is weaker than that of the weakly crimped part 67.

The strongly crimped part 64 has the length of a distance b to match the shape of the conductor part 2 of the aluminum electric wire 40, and is tightened with a strong crimping force. The crimping force of the strongly crimped part 64 has such a magnitude that a break occurs in the solder coating film 5 which is formed on the surface of the conductor part 2 of the aluminum electric wire 40 when the strongly crimped part forming part 73 is tightened.

The length of the distance b is such a length that when the strongly crimped part forming part 73 is tightened, the solder coating film 5 on the surface of the conductor part 2 is broken and the connection of the conductor part 2 of the aluminum electric wire 40 and the conductor tightening pieces 61 of the crimped terminal 50 can be sufficiently maintained.

The weakly crimped part 65 has an expansion with a predetermined angle (α) outward relative to the strongly crimped part 64, and is tightened with a crimping force that is weaker than the tightening force of the strongly crimped part 64 in the length of a distance a. The crimping force of the weakly crimped part 65 has such a magnitude that a break will not occur in the solder coating film 5 which is formed on the surface of the conductor part 2 of the aluminum electric wire 40 when the weakly crimped part forming part 74 is tightened.

The length of the distance a is such a length that when the weakly crimped part forming part 74 is tightened, the solder coating film 5 on the surface of the conductor part 2 is kept unbroken and the waterproofness of the conductor part 2 of the aluminum electric wire 40 can be maintained.

The bell mouse part 66 has an expansion with a predetermined angle (β) outward relative to the weakly crimped part 65, and is tightened with a crimping force that is further weaker than the tightening force of the weakly crimped part 65. The crimping force of the bell mouse part 66 is such a crimping force that when the bell mouse part forming part 75 is tightened, an edge at the bell mouse part 66 will not be produced by the bell mouse part forming part 75.

The predetermined angle (α) of the weakly crimped part 65 and the predetermined angle (β) of the bell mouse part 66 has the following relationship, $\beta>\alpha$.

The predetermined angle (α) of the weakly crimped part 65 and the predetermined angle (β) of the bell mouse part 66 are commonly formed by the upper crimping head 71.

The weakly crimped part 67 is provided at the base end side of the strongly crimped part 64, has an expansion with a predetermined angle (α) outward relative to the strongly crimped part 64, and is tightened with a crimping force that is weaker than the tightening force of the strongly crimped part 64 in the length of a distance a. The crimping force of the weakly crimped part 67 has such a magnitude that a break will not occur in the solder coating film 5 which is formed on the surface of the conductor part 2 of the aluminum electric wire 40 when the weakly crimped part forming part 76 is tightened.

The length of the distance a is such a length that when the weakly crimped part forming part 76 is tightened, the solder coating film 5 on the surface of the conductor part 2 is kept unbroken and the waterproofness of the conductor part 2 of the aluminum electric wire 40 can be maintained.

The bell mouse part 68 is provided at the base end side of the weakly crimped part 67, has an expansion with a predetermined angle (β) outward relative to the weakly crimped part 67, and is tightened with a crimping force that is further weaker than the tightening force of the weakly crimped part 67. The crimping force of the bell mouse part 68 is such a crimping force that when the bell mouse part forming part 77 is tightened, an edge at the bell mouse part 68 will not be produced by the bell mouse part forming part 77.

The predetermined angle (α) of the weakly crimped part 67 and the predetermined angle (β) of the bell mouse part 68 has the following relationship, $\beta>\alpha$.

The predetermined angle (α) of the weakly crimped part 67 and the predetermined angle (β) of the bell mouse part 68 are commonly formed by the upper crimping head 71.

Thus, according to the present embodiment 2, since the strongly crimped part 64 of the crimped terminal 50 made of copper or copper ally is strongly crimped, a good conduction between the conductor part 2 of the aluminum electric wire 40 and the strongly crimped part 64 can be maintained. Further, the solder coating film 5 which is formed on the surface of the conductor part 2 of the aluminum electric wire 40 at the weakly crimped parts 65, 67 and the bell mouse parts 66, 68 of the crimped terminal 50 is kept unbroken, and water can be prevented for a long term from invading the part of the conductor part 2 of the aluminum electric wire 40 that is exposed outside because of the solder coating film 5 formed on the outer periphery.

Further, according to the present embodiment 2, because it is not necessary to coat anticorrosion material, electrolytic corrosion at the connecting portion where the aluminum electric wire 40 and the crimped terminal 50 are connected can be prevented at a low cost.

Here, the features of the terminal attached aluminum electric wires according to the embodiments of present invention described above are briefly, collectively listed as follows, respectively.

[1] A crimped terminal attached aluminum electric wire 100 comprising an aluminum electric wire 1 and a crimped terminal 10, wherein an insulator (sheath) 4 of the aluminum electric wire 1, which has a conductor part 2 which is formed by twisting a plurality of strands 3 made of aluminum or aluminum alloy and is covered by the insulator (sheath) 4, is peeled, a conductor crimping part 13 of the crimped terminal 10 made of copper or copper alloy is crimped and connected to the exposed conductor part 2 so that the distal end side of the conductor part 2 is exposed from the conductor crimping part 13, a solder coating film 5 is formed when the whole outer periphery of the conductor part 2 is coated with solder 5*a*, the conductor part 2 which is coated with the solder 5*a* is placed on the conductor crimping part 13 of the crimped terminal 10, the conductor crimping part 13 is tightened so that a strongly crimped part 24 where the solder coating film 5 of the conductor part 2 is crimped with such a strength that a break occurs due to the crimping force, and a weakly crimped part 25 at the distal end side of the strongly crimped part 24 where the solder coating film 5 is crimped with such a strength that a break will not occur due to the crimping force are formed, and the conductor part 2 and the conductor crimping part 13 are electrically connected.

[2] The crimped terminal attached aluminum electric wire 100 according to the above [1], wherein at the distal end side of the weakly crimped part 25, a bell mouse part 26 is formed to be adjacent to the weakly crimped part 25.

[3] A crimped terminal attached aluminum electric wire 200 comprising an aluminum electric wire 40 and a crimped terminal 50, wherein an insulator (sheath) 4 of the aluminum electric wire 40, which has a conductor part 2 which is formed by twisting a plurality of strands 3 made of aluminum or aluminum alloy and is covered by the insulator (sheath) 4, is peeled, a conductor crimping part 53 of the crimped terminal 50 made of copper or copper alloy is crimped and connected to the exposed conductor part 2 so that the distal end side and the base end side of the conductor part 2 are exposed from the conductor crimping part 53, a solder coating film 5 is formed when the whole outer periphery of the conductor part 2 is coated with solder 5*a*, the conductor part 2 which is coated with the solder 5*a* is placed on the conductor crimping part 53 of the crimped terminal 50, the conductor crimping part 53 is tightened so that a strongly crimped part 64 where the solder coating film 5 of the conductor part 2 is crimped with such a strength that a break occurs due to the crimping force, and weakly crimped parts 65, 67 respectively at the distal end side and the base end side of the strongly crimped part 64 where the solder coating film 5 is crimped with such a strength that a break will not occur due to the crimping force are formed, and the conductor part 2 and the conductor crimping part 53 are electrically connected.

[4] The crimped terminal attached aluminum electric wire 200 according to the above [3], wherein at the distal end side of the weakly crimped part 65, a bell mouse part 66 is formed to be adjacent to the distal end of the weakly crimped part 65, and at the base end side of the weakly crimped part 67, a bell mouse part 68 is formed to be adjacent to the base end of the weakly crimped part 67.

The terminal attached aluminum electric wire of the present invention is not limited to the above-described embodiments, and suitable modifications, improvements and the like can be made. Moreover, the materials, shapes, dimensions, numbers, installing places, and the like of the components in the above embodiments are arbitrarily set as far as the invention can be attained, and not particularly restricted.

This application is based on the Japanese patent application (patent application 2012-168155) filed on Jul. 30, 2012, whose content is incorporated herein by reference.

INDUSTRIAL APPLICABILITY

A terminal attached aluminum electric wire is provided for which even when the conductor part of the aluminum electric wire is crimped by the conductor crimping part of the crimped terminal, at least the solder, which is coated on the conductor part so that the conductor part of the aluminum electric wire is not exposed to external air, near the end of the conductor part is prevented from being broken, and by preventing water from invading the conductor part of the aluminum electric wire, electrolytic corrosion can be prevented from occurring.

REFERENCE SIGN LIST

1, 40 aluminum electric wire
2 conductor
4 sheath (insulator)
5*a* solder
5 solder coating film
10, 50 crimped terminal
12, 52 wire holding part
13, 53 conductor crimping part
14, 54 sheath holding part
15 covering wall
20, 22, 60, 62 bottom plate
21, 61 conductor tightening pieces
21*a*, 21*b*, 61*a*, 61*b* conductor tightening piece
23, 63 sheath tightening pieces
23*a*, 23*b*, 63*a*, 63*b* sheath tightening piece
24, 64 strongly crimped part
25, 65, 67 weakly crimped part
26, 66, 68 bell mouse part
27 ramp part
28 resin crimping part
30, 70 crimping machine
31, 71 upper crimping head
32, 72 lower crimping head
33, 73 strongly crimped part forming part
34, 74 weakly crimped part forming part
35, 75 bell mouse part forming part

The invention claimed is:

1. A crimped terminal attached aluminum electric wire comprising:

an aluminum electric wire including an insulator; and a conductor part formed by twisting a plurality of strands made of aluminum or aluminum alloy, and including a covered conductor part covered by the insulator and an exposed conductor part not covered by the insulator; and a crimped terminal including a conductor crimping part made of copper or copper alloy, the conductor crimping part being crimped and connected to the exposed conductor part so that a distal end side of the exposed conductor part is exposed from the conductor crimping part, wherein a solder coating film is formed on the whole outer periphery of the exposed conductor part, and the exposed conductor part having the solder coating film thereon is disposed on the conductor crimping part, wherein the conductor crimping part includes a first crimped part where a break has occurred in the solder coating film, and a second crimped part at the distal end side of the first crimped part where a break has not occurred in the solder coating film, and wherein the conductor part and the conductor crimping part are electrically connected.

2. The crimped terminal attached aluminum electric wire according to claim 1, wherein, at the distal end side of the second crimped part, a bell mouse part is formed adjacent to the second crimped part.

3. A crimped terminal attached aluminum electric wire comprising:

an aluminum electric wire including an insulator; and a conductor part formed by twisting a plurality of strands made of aluminum or aluminum alloy, and including a covered conductor part covered by the insulator and an exposed conductor part not covered by the insulator; and a crimped terminal including a conductor crimping part made of copper or copper alloy, the conductor crimping part being crimped to the exposed conductor part and a distal end side and a base end side of the exposed conductor part being exposed from the conductor crimping part, wherein a solder coating film is formed on the whole outer periphery of the exposed conductor part, and the exposed conductor part having the solder coating film thereon is disposed on the conductor crimping part, wherein the conductor crimping part includes a first crimped part where a break has occurred in the solder coating film, and second crimped parts respectively at the distal end side and the base end side of the first crimped part where a break has not occurred in the solder coating film, and wherein the conductor part and the conductor crimping part are electrically connected.

4. The crimped terminal attached aluminum electric wire according to claim 3, wherein at the distal end side of the second crimped part, a bell mouse part is disposed adjacent to the distal end of the second crimped part, and at the base end side of the second crimped part, a bell mouse part is disposed adjacent to the base end of the second crimped part.

* * * * *